US007857102B2

(12) United States Patent
Menard

(10) Patent No.: US 7,857,102 B2
(45) Date of Patent: Dec. 28, 2010

(54) RETAIL STORE CONSTRUCTION AND METHODS OF STORING AND DISPLAYING MERCHANDISE

(75) Inventor: John R. Menard, Eau Claire, WI (US)

(73) Assignee: Menard, Inc., Eau Claire, WI (US)

( * ) Notice: Subject to any disclaimer, the term of this patent is extended or adjusted under 35 U.S.C. 154(b) by 1385 days.

(21) Appl. No.: 11/021,470

(22) Filed: Dec. 23, 2004

(65) Prior Publication Data

US 2006/0150547 A1 Jul. 13, 2006

(51) Int. Cl.
*E04H 3/02* (2006.01)

(52) U.S. Cl. ..... 186/52

(58) Field of Classification Search ..... 186/52, 186/59; 52/185
See application file for complete search history.

(56) References Cited

U.S. PATENT DOCUMENTS 1,511,508 A * 10/1924 Cytron ..... 312/118
1,857,189 A * 5/1932 Gillespie ..... 52/36.2
3,803,778 A 4/1974 Short
3,846,947 A 11/1974 Short
3,992,824 A * 11/1976 Miller, Jr. ..... 52/29
4,472,912 A * 9/1984 Pipp ..... 52/28
4,604,838 A 8/1986 Remington et al.
4,618,031 A * 10/1986 Belloche ..... 186/52
4,759,162 A 7/1988 Wyse
4,804,307 A 2/1989 Motoda
5,720,135 A 2/1998 Paquette
5,826,386 A 10/1998 Casteel
6,405,496 B1 * 6/2002 Stewart et al. ..... 52/185
2003/0167701 A1 9/2003 Rich

FOREIGN PATENT DOCUMENTS

DE 3610448 10/1986
FR 2580695 10/1986
JP 2282545 11/1990

* cited by examiner

*Primary Examiner*—Stefanos Karmis
*Assistant Examiner*—Mark Beauchaine
(74) *Attorney, Agent, or Firm*—Merchant & Gould P.C.

(57) ABSTRACT

A building construction includes an exterior structure, a secondary floor, and an access structure. The exterior structure includes at least four exterior walls, a primary floor and a roof defining a primary storage space wherein merchandise is stored and displayed. The secondary floor defines a secondary storage and display space within the primary storage space. The secondary floor is spaced above the primary floor a distance sufficient for the display of merchandise between the secondary and primary floors. The secondary floor is also exposed within the primary interior storage space. The access structure provides access between the primary floor and the secondary storage and display space. An excess number of merchandise items stored on the primary floor are stored in the secondary storage space and accessible via the access structure.

37 Claims, 10 Drawing Sheets

RETAIL STORE CONSTRUCTION AND METHODS OF STORING AND DISPLAYING MERCHANDISE

BACKGROUND OF THE INVENTION

1. Field of the Invention

The present invention generally relates to building structures and storage methods, and more particularly relates to retail store constructions and methods of storing, displaying, and retailing merchandise within a retail store.

2. Related Art

Retail stores typically include at least one room for displaying merchandise items. The merchandise may be displayed on rows of shelves, on stands positioned on the primary floor of the room, on the walls, hanging from the ceiling, or at other locations within the display room such that the customer can view the displayed items from the primary floor. In many retail stores, one objective is to provide the customer with many options so that the customer can make a selection based on different prices, brands, quality, etc. for any type of merchandise. For most merchandise, the customer prefers to view the item up close and sometimes hold or touch the item. For this reason, displaying merchandise on the primary floor and within reach of a customer positioned on the primary floor of the display room is often preferred.

Another objective for retail stores is to stock excess numbers of the displayed merchandise so that a customer request for the item can always be met. A related objective is to store the excess number of items within close proximity to the merchandise display so that the customer can select the item for himself or herself or an employee of the retail store can obtain the item for the customer without the customer having to wait for an extended time period.

Different retail stores address these objectives in different ways. In one example, the excess number of merchandise items are stored on shelves that extend directly above where the merchandise is displayed on the primary floor. This arrangement is common in warehouse style retail stores that have high ceilings. The space above the merchandise displays can be used effectively as storage space for the excess numbers of displayed items. In this way, the amount of floor space is optimized for displaying a large number of items and the excess number of displayed merchandise is stored in close proximity for quick and relatively easy attainment by the customer or store employee.

A drawback of this arrangement is that the person acquiring the item must use a ladder or other lift mechanism to elevate himself or herself. Also, the item being obtained may be awkward in size or shape (e.g., large or bulky) or have a weight making it difficult to maneuver. A still further drawback of this arrangement is that the retail store can have the appearance of a warehouse wherein the room appears to be filled from the floor to the ceiling with goods.

Another example retail store arrangement uses storage of excess merchandise items at a remote location from the area or room where the merchandise is displayed. The remote storage location may be in a separate room on the same level as the primary floor, on a separate floor that is removed from the display room, or in a different building in close proximity to the retail store. This arrangement also provides optimization of the primary floor space for the display of many different items. However, a disadvantage of this arrangement is that large amounts of time may be required to obtain an item requested by the customer and the customers cannot typically obtain the item themselves without significant additional effort.

Yet a further example retail store arrangement, which is, in fact, most common for retail stores, is to store excess numbers of a displayed merchandise item at a location immediately surrounding the merchandise display. Examples of such arrangements include storing excess items on a shelf behind the displayed item or on a peg behind the displayed item also hanging on the peg. In another example, the excess items may be stacked to form a display base for the displayed item. This retail store arrangement does not typically optimize the use of the primary floor space. In fact, when dealing with large or bulky items, this arrangement while providing easy and quick access to the excess numbers of the displayed merchandise can result in a very inefficient use of floor space.

A retail store construction and method of storing, displaying, and retailing merchandise that addresses these and other disadvantages would be an advance in the art.

SUMMARY OF THE INVENTION

The present invention relates to retail store constructions and methods of storing, displaying, and retailing merchandise within a retail store. An example retail store construction provides for the storage of excess numbers of a merchandise item that is displayed on a primary retail floor of the store. The storage location is preferably positioned at a different vertical height than the retail floor on a secondary platform or floor. The secondary platform or floor is positioned generally within the same room or area that includes the primary retail floor. Excess numbers of other merchandise items that are displayed at other locations within the retail store may also be stored on the secondary platform or floor. Access to the secondary platform or floor is preferably restricted to employees of the retail store.

One aspect of the invention relates to a building construction that includes an exterior structure, a secondary floor, and an access structure. The exterior structure includes at least four exterior walls, a primary floor and a roof defining a primary storage space wherein merchandise is stored and displayed. The secondary floor defines a secondary storage and display space within the primary storage space. The secondary floor is spaced above the primary floor a distance sufficient for the display of merchandise between the secondary and primary floors. In some embodiments, the secondary floor is spaced above the primary floor a distance sufficient for the placement of a plurality of shelves, racks, or stands beneath and spaced below the secondary floor. In another embodiment, the secondary floor is spaced above the primary floor a distance sufficient for customers to walk under the secondary floor to observe displayed merchandise positioned between the primary and secondary floors. The secondary floor is also exposed within the primary interior storage space. The access structure provides access between the primary floor and the secondary storage and display space. An excess number of merchandise items stored on the primary floor are stored in the secondary storage space and accessible via the access structure.

Another aspect of the invention relates to a storage arrangement for merchandise in a retail store. The retail store includes a primary storage volume defined between a primary floor and a ceiling of the store. A secondary floor is positioned within the primary storage volume and is raised relative to the primary floor a distance sufficient for customers to walk between the primary and secondary floors. The storage arrangement includes a plurality of different merchandise items displayed on the primary floor for selection by a consumer and an additional number of at least some of the different merchandise items stored on the secondary floor. The additional number of merchandise items are preferably accessible only by an employee of the retail store.

Another aspect of the invention relates to a merchandise arrangement in a building configured for retail sales. The building defines a first room having a primary floor and a second room having a secondary floor wherein the second room is positioned within the first room at a location spaced vertically above the primary floor. The arrangement includes a display of merchandise on the primary floor and storage of a supply of at least some of the displayed merchandise in the second room.

A further aspect of the invention relates to a method of obtaining merchandise for a customer in a retail store. A display of the merchandise is positioned at a primary floor level in the retail store and an excess number of the merchandise is stored at a secondary floor level that is positioned vertically above the primary floor level. The primary and secondary floor levels are positioned within the same room of the retail store. The method includes the steps of obtaining a merchandise request from the customer based on the customer's review of the displayed merchandise, accessing the stored excess number of the merchandise at the secondary floor level by an employee of the retail store, and delivering the requested merchandise to the customer in a timely manner.

Another method according to principles of the invention relates to a method of retailing merchandise. The method includes providing a retail space having a primary floor that includes a checkout stand and a plurality of merchandise displays, and a secondary floor positioned vertically above the primary floor a distance sufficient for customers to walk or a plurality of merchandise display shelves or stands to be positioned between the primary and secondary floors. The secondary floor is viewable within a portion of the retail space that includes the primary floor. The method also includes storing excess numbers of the displayed merchandise on the secondary floor, obtaining a merchandise request from a customer that views the merchandise displays, obtaining the requested merchandise from the secondary floor on behalf of the customer, and transacting a purchase of the requested merchandise at the check out stand.

The above summary of the present invention is not intended to describe each disclosed embodiment or every implementation of the present invention. In particular, the example embodiments described below in relation to the Figures are the application of the present invention in a retail store, whereas many other types of buildings may be applicable to fulfill the purposes and intents of the present invention. Figures in the detailed description that follow more particularly exemplify certain embodiments of the invention. While certain embodiments will be illustrated and described herein, the invention is not limited to use in such embodiments.

BRIEF DESCRIPTION OF THE DRAWINGS

The invention may be more completely understood in consideration of the following detailed description of various embodiments of the invention in connection with the accompanying drawings, in which.

While the invention is amenable to various modifications and alternate forms, specifics thereof have been shown by way of example and the drawings, and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE PREFERRED EMBODIMENT

The present invention generally relates to building structures and storage methods, and more particularly relates to retail store constructions and methods of storing, displaying, and retailing goods within a retail store. The example store constructions and methods of storing and retailing described herein provide many advantages. One advantage is the potential reduction in the amount of floor space taken up on the primary floor of the store by excess number of displayed merchandise. Another advantage is that excess numbers of merchandise displayed on the primary or main floor of the retail store can be stored within the store retail space at a location removed from the area where the item is displayed. The excess number of merchandise items can be stored at a secondary storage floor or area that is accessible by employees of the store. The secondary area may be in an area of the store that is otherwise unused primarily for retail display such as, for example, at a position vertically raised above the primary retail floor.

Figure 1:
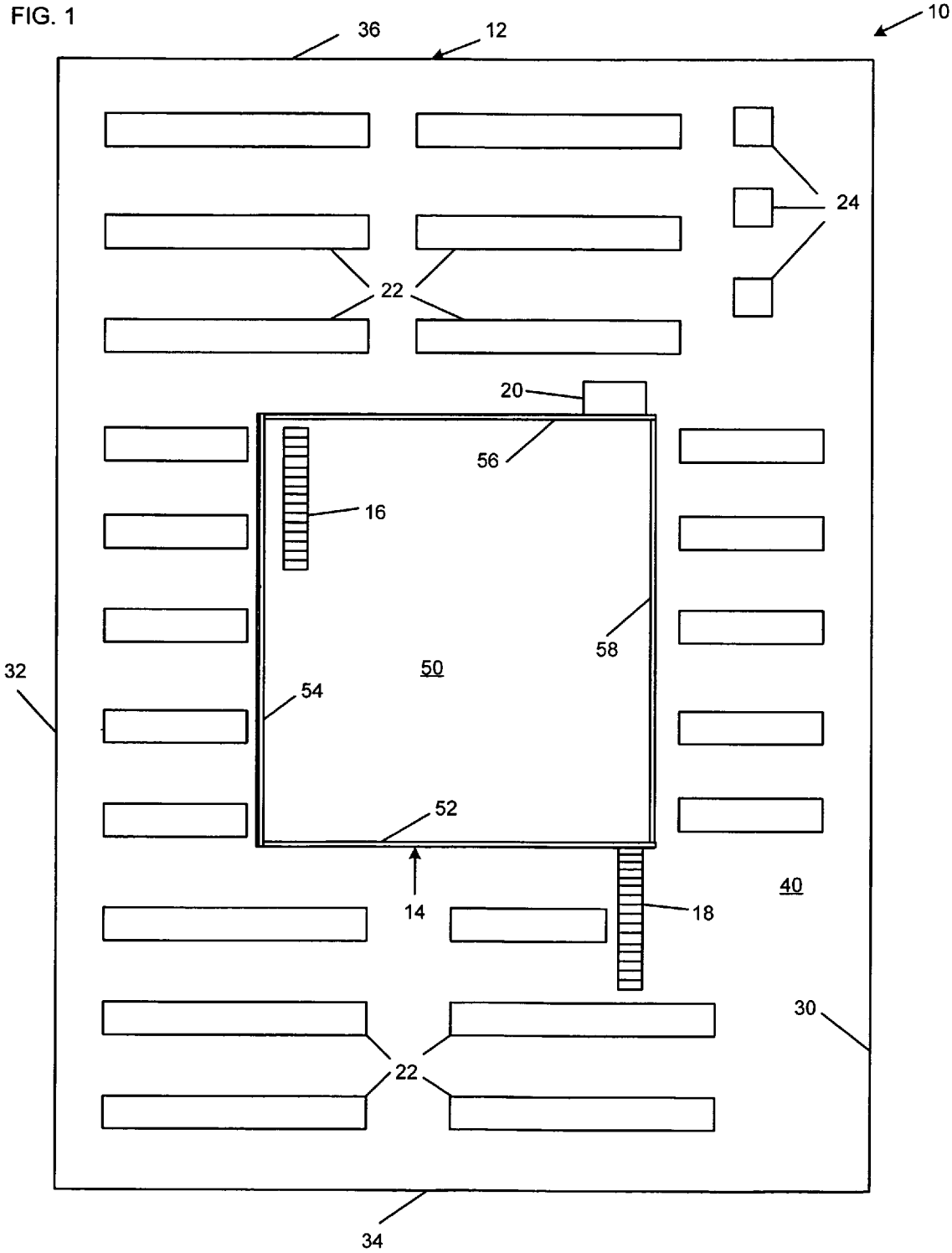
FIG. 1 is a top view of a retail store interior according to principles of the present invention having a raised storage and display area above the main retail floor.
Figure 2:
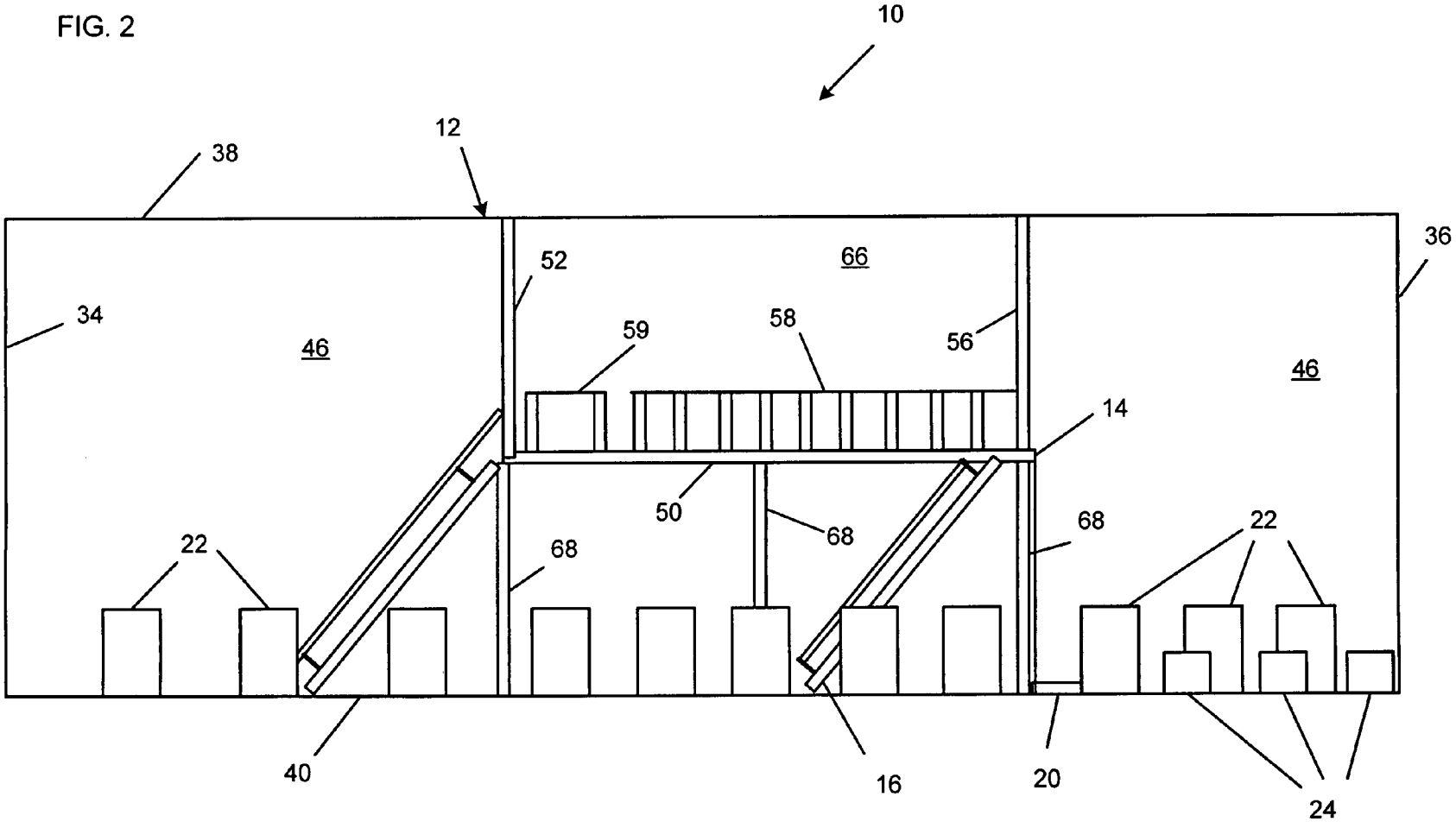
FIG. 2 is a side view of the retail store interior shown in FIG. 1.

Referring now to FIGS. 1 and 2, an example building construction 10 is shown and described. Building construction 10 includes an exterior structure 12 and a secondary floor structure 14 positioned within the exterior structure 12. A number of access structures may be used to gain access to the secondary floor structure. First and second stairs 16, 18 and a lift 20 are shown providing access to the secondary floor structure 14 at various locations. A number of merchandise displays or display structures such a display shelves 22 may be positioned throughout the building construction for the display of merchandise items. A number of checkout stands 24 may be positioned at any location within the building construction 10 and may be used by customers to purchase the merchandise items that they have selected.

The exterior structure 12 includes front and rear walls 30, 32, first and second sidewalls 34, 36, a roof 38, and a primary floor 40. The walls, roof and floor of the exterior structure define a retail space or retail volume 46. It is within this retail space 46 that the secondary floor structure 14, the merchandise and display shelves 22, and checkout stands 24 along with various access structures may be positioned.

The exterior structure 12 may have any shape or size desired. In one example, the exterior structure 12 defines a retail space 46 having a primary floor 40 with dimensions of about 500 feet×320 feet for a total of about 160,000 square feet of floor space. In another example, the exterior structure defines a primary floor having dimensions of about 600 feet× 375 feet for a total of about 225,000 square feet of floor space. Other embodiments may have square footage smaller or greater than these examples.

The volume of the retail space 46 is defined by the dimensions of the primary floor and the height of the walls 30, 32, 34, 36. In one example, the height of the walls is about 20 to 40 feet, and more specifically about 25 to 30 feet. Such an exterior structure 12 having high ceilings and a very large primary floor dimension is sometimes known as a warehouse style building. Some types of warehouse style buildings do not include additional support structures throughout the retail space for support of the roof because the roof is supported only around the walls of the exterior structure. Other warehouse style buildings include additional support structures within the retail space that extend from the floor to the roof to provide the desired support of the roof.

A warehouse style building with high ceilings provides space within which a secondary floor may be positioned as a second level that is vertically raised above the primary floor. The secondary floor structure 14 shown in FIGS. 1 and 2 is positioned within the retail space 46 at a vertically raised position between the roof 38 and primary floor 40. The secondary floor structure 14 includes a floor 50, a plurality of walls, 52, 54, 56, a rail 58, a gate 59 (for a lift mechanism that travels from the primary floor 40 to the secondary floor structure 14), and a plurality of support posts 68. The walls 52, 54, 56, rail 58, and roof 38 together define a secondary room or storage space 66 within the secondary floor structure 14. The first and second stairs 16, 18 and lift 20 provide access between the primary floor 40 and the floor 50 within the storage space 66.

Preferably, the secondary floor structure 14 is positioned at least 10 to 15 feet above the primary floor 40 and more preferably about 12 to 13 feet above the primary floor 40. This amount of spacing provides sufficient room for displaying or storing merchandise items in the space between the floor 50 of the secondary floor structure 14 and the primary floor 40. As a result, the presence of the secondary floor structure 14 does not significantly reduce the amount of display and/or storage space on the primary floor 40 for merchandise items.

The walls 52, 54, 56 and rail 58 may be solid walls that extend from the floor 50 to the roof 38, or may be partial walls having a reduced height such as, for example, 3 to 8 feet. In some example configurations, one or more of the walls 52, 54, 56 may be replaced with a rail-type structure such as rail 58, and rail 58 may be replaced with a solid wall. In some embodiments, any of the walls 52, 54, 56 and rail 58 may be removed altogether such that the storage space 66 is completely open for viewing from the primary floor 40.

Support posts 68 may be positioned along the edges of the floor 50 and may be interspersed between the edges of the floor 50. The support posts 68 may extend from the primary floor 40 to the floor 50. In some embodiments, the posts 68 or other posts may extend additionally from the floor 50 to the roof 38 to provide additional support and stability for secondary floor structure 14.

The floor 50 may be at least partially removed in certain locations to provide access into the storage space 66. For example, a rectangular hole may be formed in the floor 50 to provide an entrance for stairs 16. In other embodiments, the floor may include additional openings for different sets of stairs and/or the lift mechanism 20. The walls 52, 54, 56 and rail 58 may also have sections removed therefrom in order to provide access laterally into the storage space 66. For example, the gate 59 may be positioned along the length of the rail 58 to provide access into the storage space 66 from the side using, for example, a forklift that drives along the primary floor 40 and places a load on the floor 50 from a side of the secondary floor structure 14. The wall 56 may also include an opening, gate or other access type structure to permit loads to move on and off the lift 20 when the lift is raised to a level substantially parallel with the floor 50.

Figure 3:
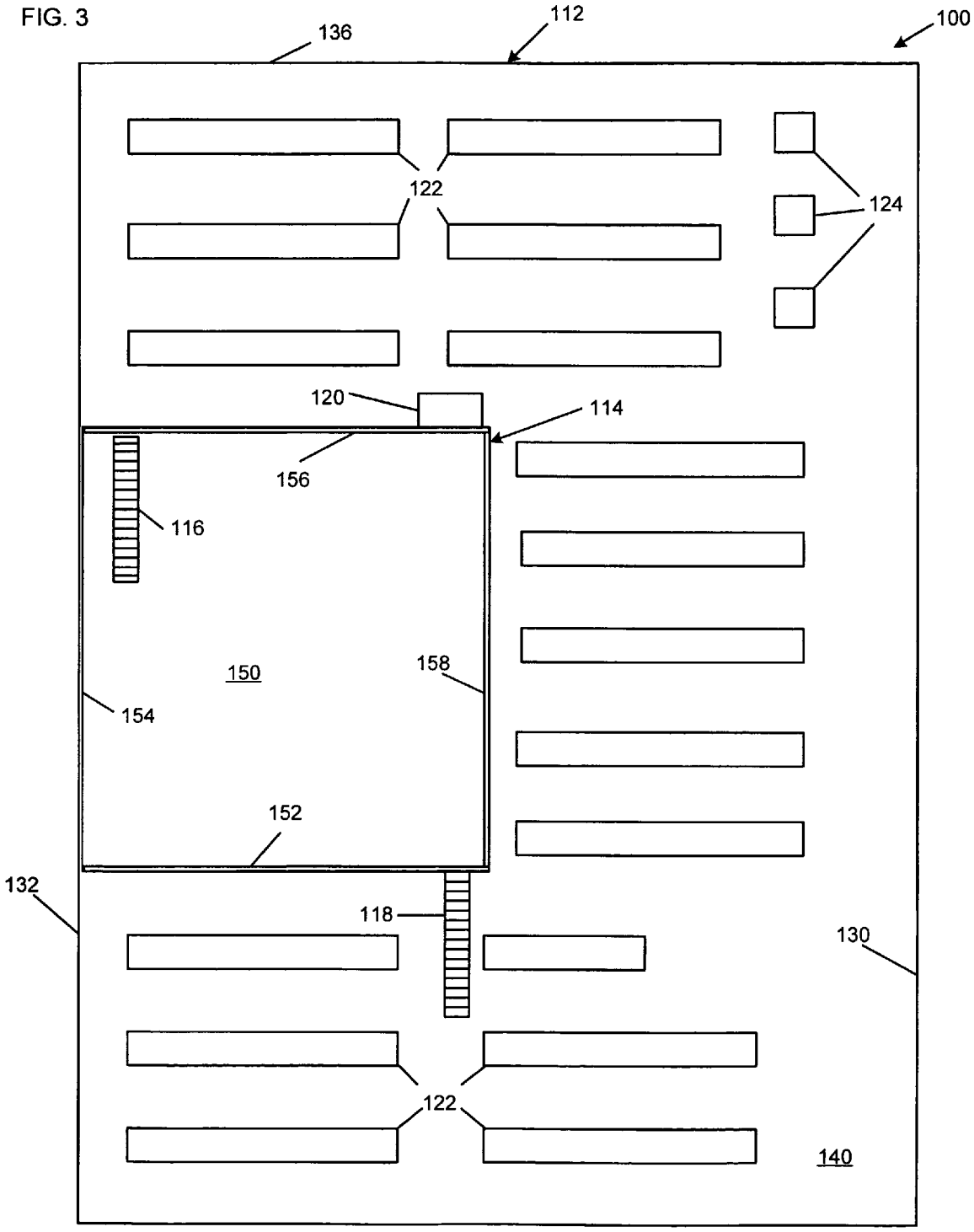
FIG. 3 is top view of another retail store interior having a raised storage area according to principles of the present invention.
Figure 4:
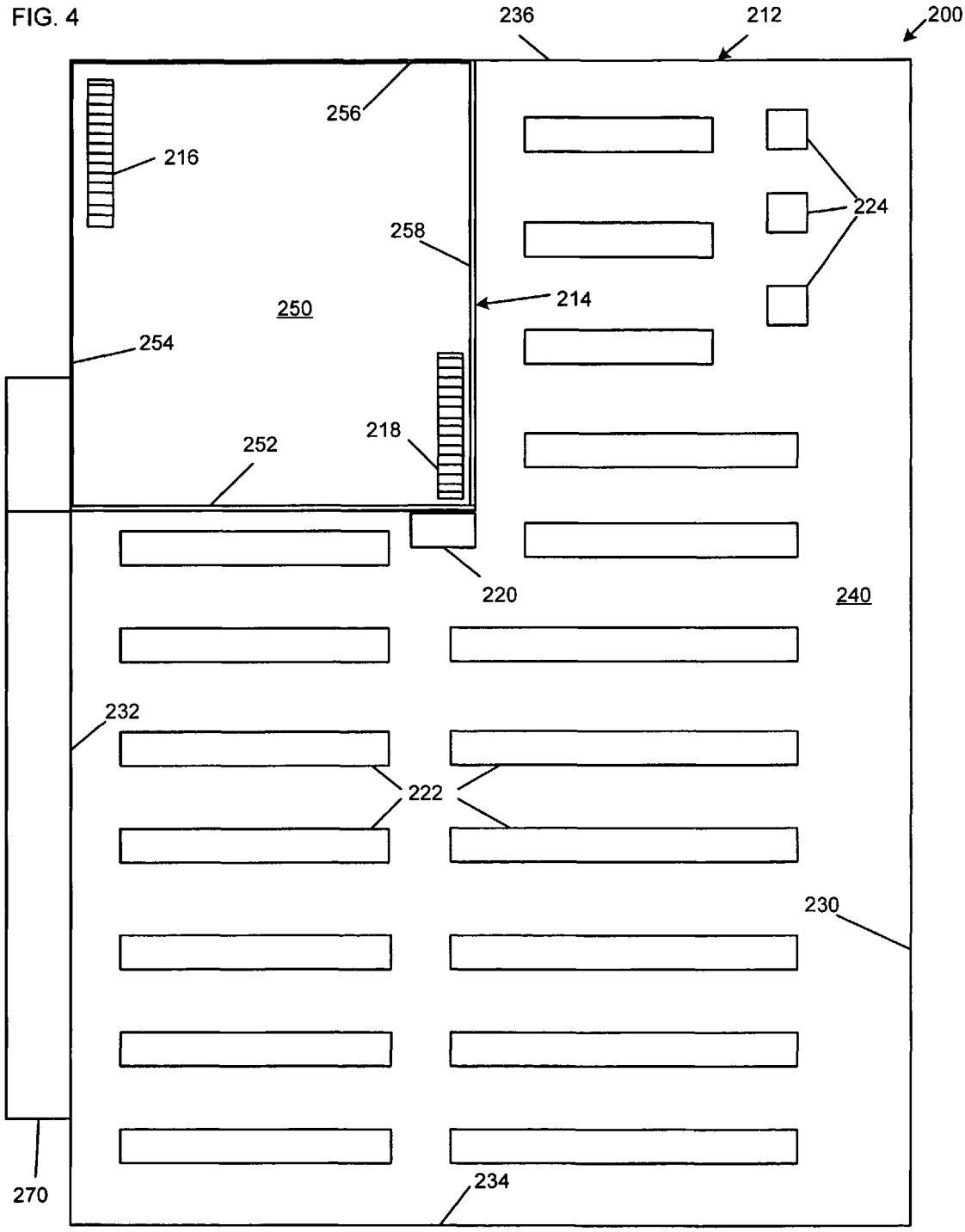
FIG. 4 is a top view of yet another retail store interior having a raised storage area according to principles of the present invention.

The secondary floor structure 14 is shown in FIGS. 1 and 2 positioned generally at a center of the retail space 46. FIGS. 3 and 4 illustrate a secondary floor structure positioned at alternative positions within the retail space defined by the exterior structure. Referring first to FIG. 3, a building construction 100 includes an exterior structure 112 and a secondary floor structure 114. Access structures including first and second stairs 116, 118 and a lift 120 may be used to provide access to the secondary floor structure 114. A number of display shelves 122 and checkout stands 124 are positioned within the exterior structure 112.

The exterior structure 112 includes front and rear walls 130, 132, first and second sidewalls 134, 136, and a primary floor 140. A secondary floor structure 114 is positioned along the rear wall 132 and spaced apart from any of the four corners defined by the intersection of the walls 130, 132, 134, 136.

The secondary floor structure 114 includes a floor 150, walls 152, 154, 156, 158. The secondary floor structure 114 may have the same or similar features as the secondary floor structure 14 described above and shown in FIGS. 1 and 2.

Referring next to FIG. 4, a building construction 200 includes an exterior structure 212 and a secondary floor structure 214 positioned within the exterior structure. The exterior structure 212 includes front and rear walls 230, 232, first and second sidewalls 234, 236, and a primary floor 240. The secondary floor structure 214 is positioned in a corner of the exterior structure adjacent to the second sidewall 236 and the rear wall 232. A number of display shelves 222 and checkout stands 224 may be positioned around and underneath the secondary floor structure 214 at various locations on the primary floor 240.

The secondary floor structure 214 may include a floor 250, and a plurality of walls 252, 254, 256, 258. The walls 254, 256 may be integral with or stand separately from the rear wall 232 and sidewall 236 of the exterior structure 212. The secondary floor structure 214 may include the same or similar features as described above related to secondary floor structure 14. For example, the floor 50 may include removed or cut out portions to provide access by the stairs 216, 218 and lift 220. Also, the walls 252, 258 may have any size, shape, or structure as described above with reference to walls 52, 54, 56 and rail 58 described above.

Figure 6:
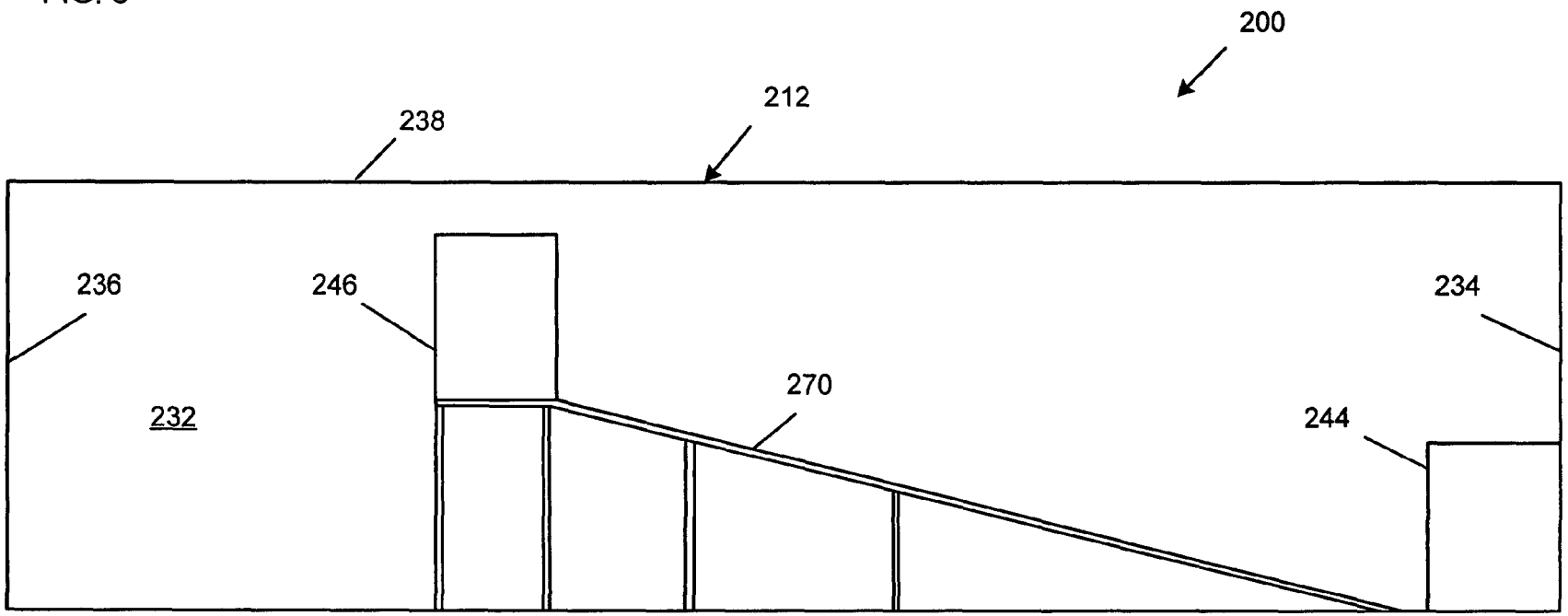
FIG. 6 is a rear view of an exterior of the retail store shown in FIG. 3.

Referring now to FIGS. 4 and 6, the building construction 200 may also include a ramp 270. The ramp 270 extends from ground level or at a level substantially co-planar with the primary floor 240, to a level substantially co-planar with the floor 250 of the secondary floor structure 214. The ramp 270 is shown mounted to or positioned adjacent to the rear wall 232 of the exterior structure 212. A door or opening 246 is provided at the top of the ramp 270 to provide access directly onto the floor 250. The ramp 270 is preferably configured for use by a self-powered vehicle such as a forklift or other delivery device that can transport items from ground level to the secondary floor structure. Preferably, the ramp is positioned outside of the exterior structure 212. In other embodiments, the ramp 270 may be positioned within the exterior structure. For example, a lower door 244 may provide access into the exterior structure 212 wherein the ramp is oriented such that a vehicle may drive up the ramp and onto the floor 250 of the secondary floor structure 214 while the vehicle is within the exterior structure 212. The position of the ramp 270 inside or outside of the exterior structure 212 may provide certain advantages such as ease of accessibility to the secondary floor structure 214, the protection of merchandise during transport, and optimizing allocation of storage, display, and/or retail space.

Figure 5:
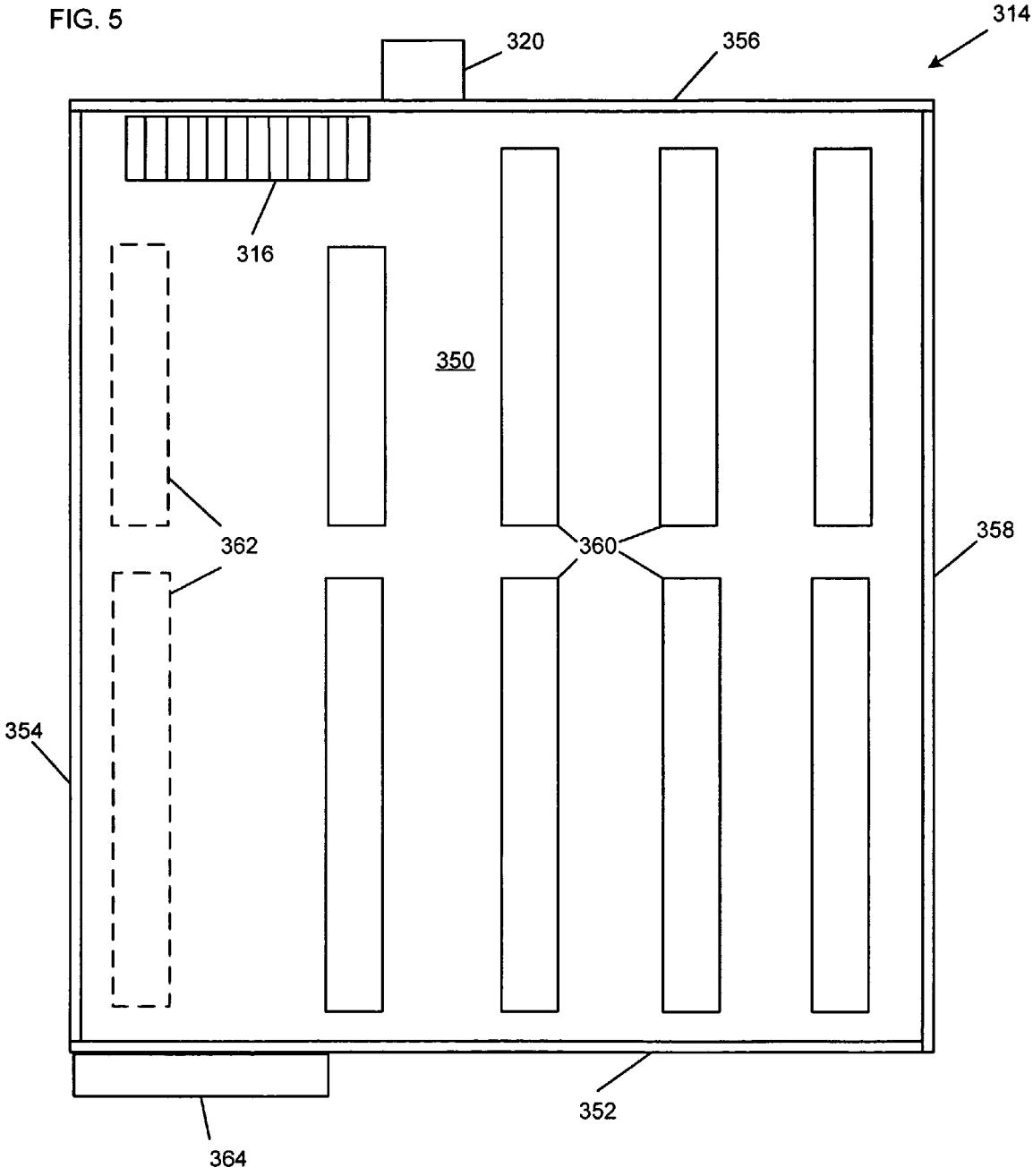
FIG. 5 is a detailed top view of an example raised storage area according to principles of the present invention.

Referring now to FIG. 5, an example secondary floor structure 314 is described in detail. The secondary floor structure 314 includes walls 352, 354, 356, 358 and floor 350. A plurality of stands or shelves 360 may be positioned within the walls and on top of the floor 350. The shelves 360 may be used for storing excess numbers of merchandise that are displayed on the primary floor of a building construction within which the secondary floor structure 314 is positioned. A set of stairs 316 and a lift mechanism 320 may be used to provide access between the secondary floor structure 314 and the primary floor positioned beneath the secondary floor structure 314.

Secondary floor structure 314 may include display areas 362 in which merchandise may be displayed for viewing from the primary floor. In order to observe merchandise displayed in the display areas 362, the wall 354 is preferably constructed as a rail structure or as a partial height or partially removed wall structure so as to minimize viewing obstruction to the merchandise displayed in areas 362. A display stand 364 may extend from a side edge of the secondary floor structure 314. The display stand 364 may also be used to display merchandise. In some embodiments, the display stand may be positioned at raised or lowered levels relative to the height of floor 350. In still other embodiments, the display stand may extend along the entire length of a side edge of floor 350 or around substantially the entire circumference of the floor 350. The merchandise displayed in area 362 and on stand 364 is generally large and bulky and, therefore, is preferably merchandise that is not also displayed on the primary floor of the building construction. Excess numbers of the merchandise displayed in area 362 and on stand 364 may be stored on shelves 360 or on other areas of the floor 350.

The secondary floor structure 314 (as with secondary floor structures 14, 114, 214) may have any desired shape and size. The example secondary floor structure 314 is a generally rectangular shaped structure. Other possible shapes include shapes with three or more sides that each face in any desired direction. A secondary floor structure with three or more sides may be advantageous for many reasons. Each side of the secondary floor provides a raised exposed surface area that may be used for displaying merchandise, hanging advertisements, or communicating information to customers positioned on the primary floor. Each side of the secondary floor structure may be oriented in a different direction so as to provide viewing from many different angles and/or desired positions on the primary floor.

In one example embodiment, the secondary floor structure has a floor surface area greater than 500 square feet and less than the square footage of the primary floor, more preferably about 2,000 to 15,000 square feet, and most preferably about 10,000 square feet. In one example, the secondary floor structure has a floor dimension of about 135 feet by about 75 feet. The secondary floor preferably has dimensions that are greater than at least two rows of shelves, stands, or aisles of displayed merchandise. The structures positioned underneath the secondary floor for purposes of displaying merchandise are preferably spaced below the bottom surface of the secondary floor and do not extend from the primary floor to the secondary floor. However, some embodiments may include structures for displaying merchandise that also at least partially support the secondary floor.

The height of the secondary floor structure, as described above, is preferably positioned at about 8 to 15 feet above the primary surface of the building construction, and is most preferably about 12 to 14 feet. The secondary floor is spaced above the primary floor a distance sufficient for the display of merchandise between the secondary and primary floors. In some embodiments, the secondary floor is spaced above the primary floor a distance sufficient for the placement of a plurality of shelves, racks, or stands beneath and spaced between the secondary and primary floors. In another embodiment, the secondary floor is spaced above the primary floor a distance sufficient for customers to walk under the secondary floor to observe displayed merchandise positioned between the primary and secondary floors. Further, the floor of the secondary floor structure is positioned at about 10 to 20 feet from the ceiling (the ceiling being defined in part by the roof of the exterior structure of the building) and more preferably about 10 to 15 feet from the ceiling.

Figure 7:
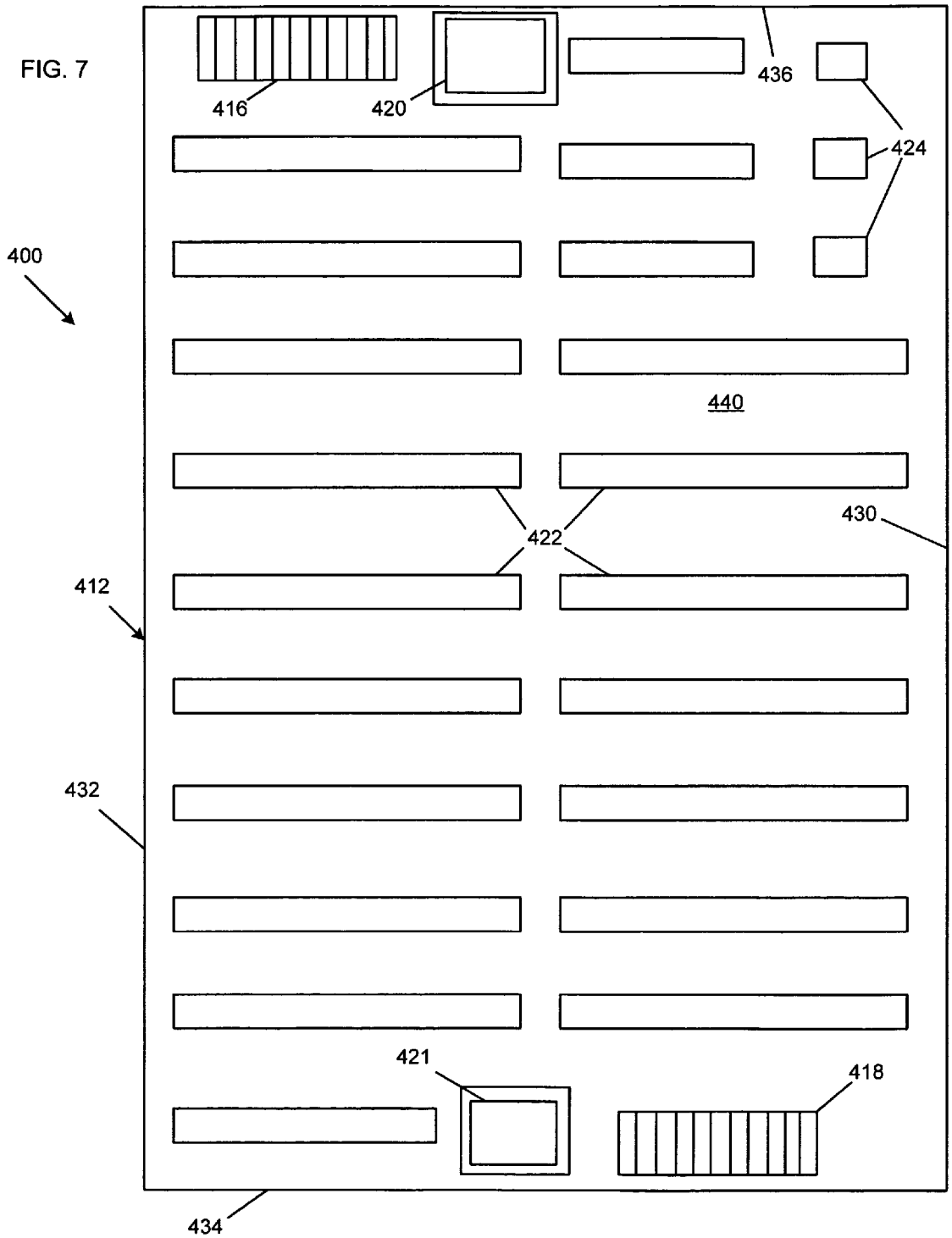
FIG. 7 is side view of another retail store interior according to principles of the present invention, the retail store having a lowered storage area positioned below the main retail floor.
Figure 8:
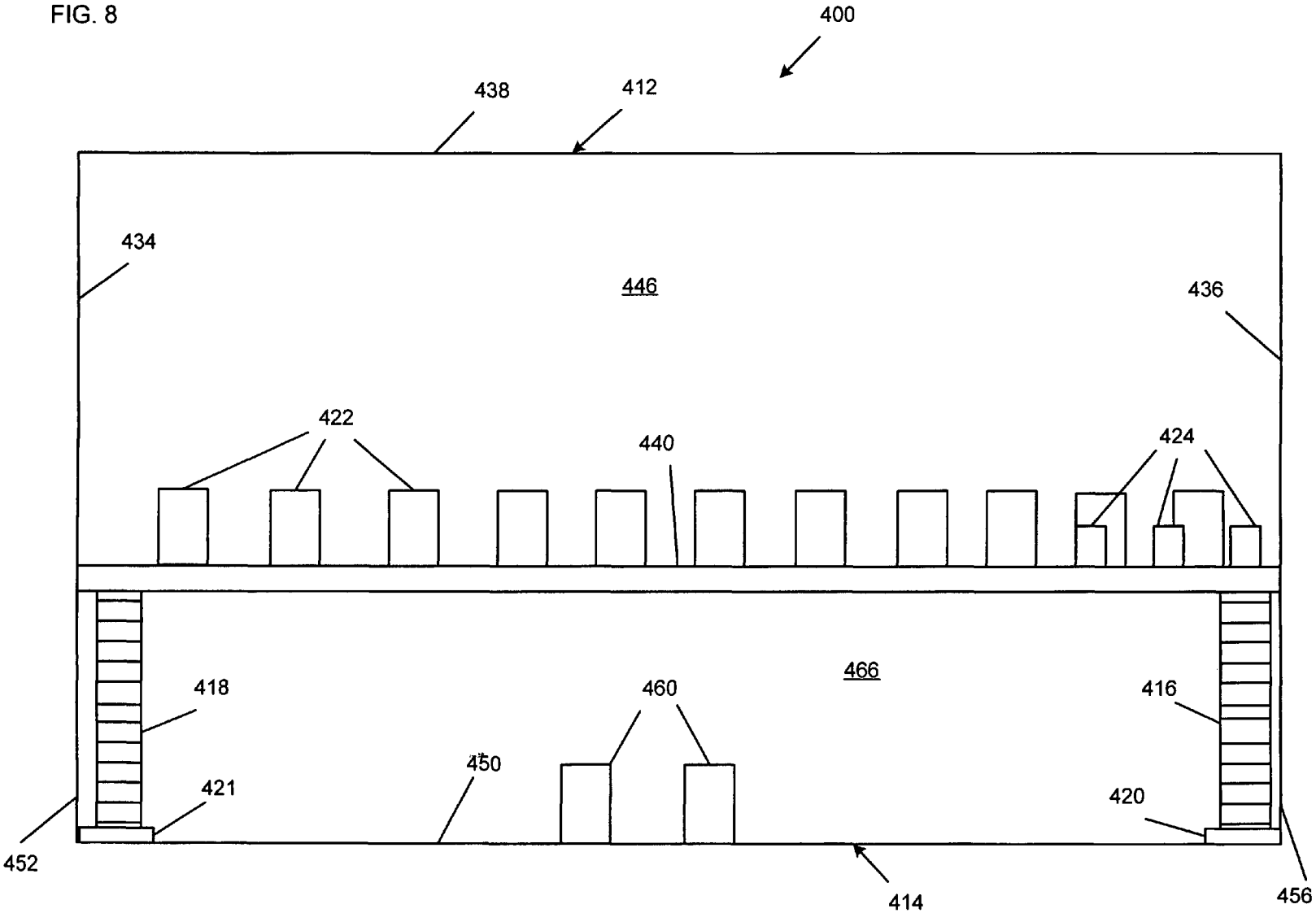
FIG. 8 is top view of the lowered storage area shown in FIG. 7.

Referring now to FIGS. 7 and 8, another example building construction 400 is shown and described. The building construction 400 includes an exterior structure 412 and a secondary floor structure 414. The secondary floor structure 414 is positioned vertically below the exterior structure 412. First and second stairs 416, 418 and a pair of lift mechanisms 420, 421 provide access to the secondary floor structure 414.

The exterior structure 412 includes front and rear walls 430, 432, first and second sidewalls 434, 436, a roof 438, and a primary floor 440. The secondary floor structure 414 includes a floor 450, at least two walls 452, 456, and other walls (not shown) that together define a secondary room or storage space 466. Within the storage space 466 are a plurality of shelves 460 for the storage of excess numbers of merchandise items that are displayed on the primary floor 440.

A plurality of display shelves 422 and checkout stands 424 are positioned on the primary floor 440 where merchandise is displayed and customers can purchase the merchandise items. Excess numbers of the displayed merchandise items can be stored within the secondary storage space 466. Access to the secondary storage space 466 is provided by the stairs 416, 418 and the lifts 420, 421. The secondary floor structure 414 is particularly useful for storing bulk items that would otherwise occupy undesirable amounts of space on the primary floor 440.

The embodiments of building construction 400 may be useful as an alternative to the building constructions 10, 100, 200 discussed above if the building structure is not of a warehouse style with a high ceiling. Low ceiling building constructions would typically prohibit the use of a secondary floor structure that is spaced vertically above the primary floor. In such circumstances and when vertically lower space is available as a storage option, the building construction 400 may be useful.

In some variations of the building construction 400, sections of the primary floor 440 may be removed in excess of the openings necessary for the stairs 416, 418 and the lifts 420, 421. The removal of large portions of the primary floor 440 may define the storage space 466 and a retail space 446 as a single retail space that is merely partially separated by the primary floor 440.

Figure 9:
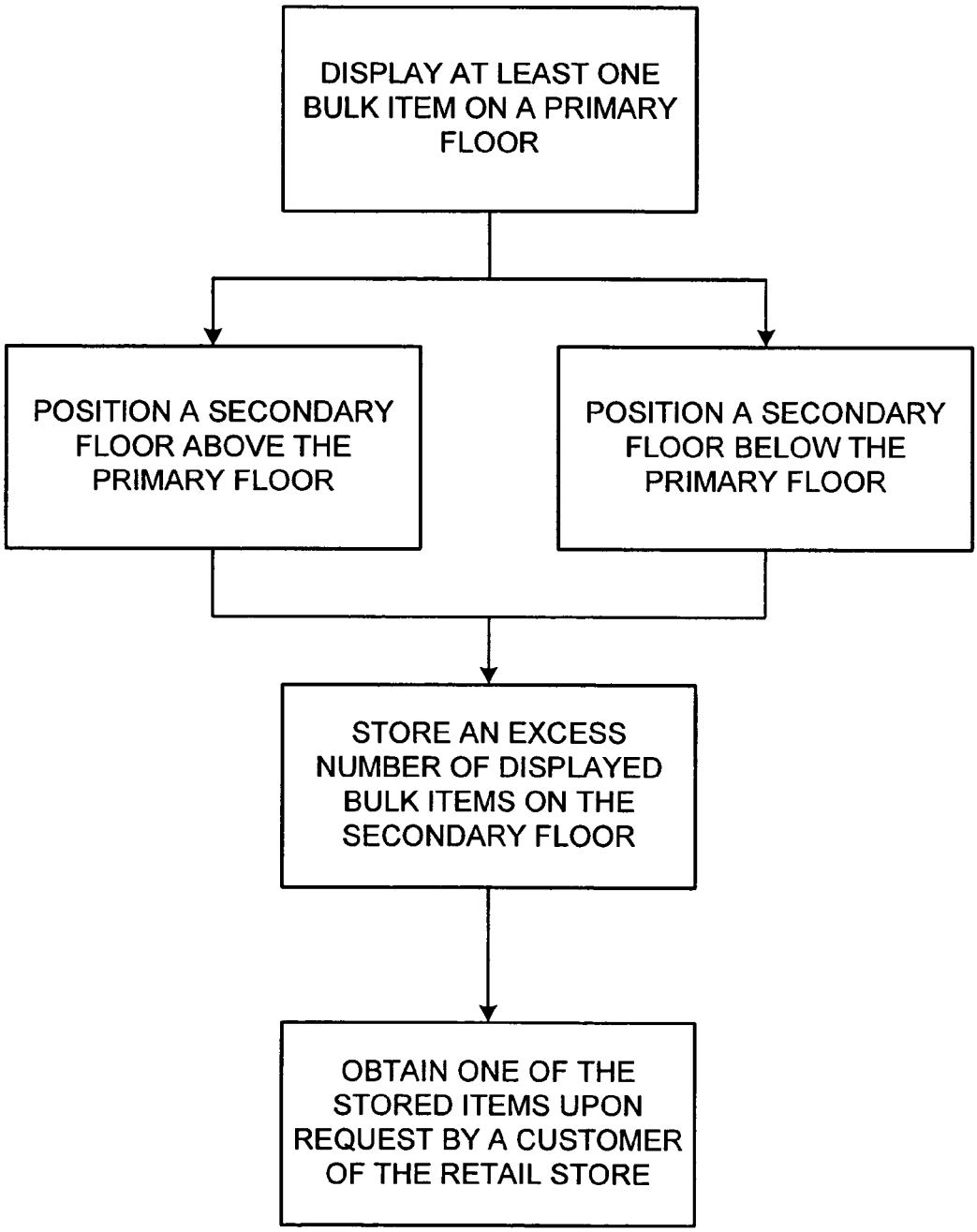
FIG. 9 is a flow diagram for an example method related to the present invention.

The building construction examples described above with reference to FIGS. 1-8 may be used in conjunction with methods of displaying, storing, and retailing merchandise within a retail store. According to one example method, (see FIG. 9) at least one bulk item is displayed on a primary floor of a building construction. A secondary floor is either positioned above or below the primary floor. An excess number of the displayed bulk items are stored on the secondary floor. One of the stored items is obtained from the secondary floor upon request by a customer of the retail store. Preferably, the secondary floor is accessible by an employee of the retail store rather than by the customer. Furthermore, the secondary floor is not used to display items that are also displayed on the primary floor.

Figure 10:
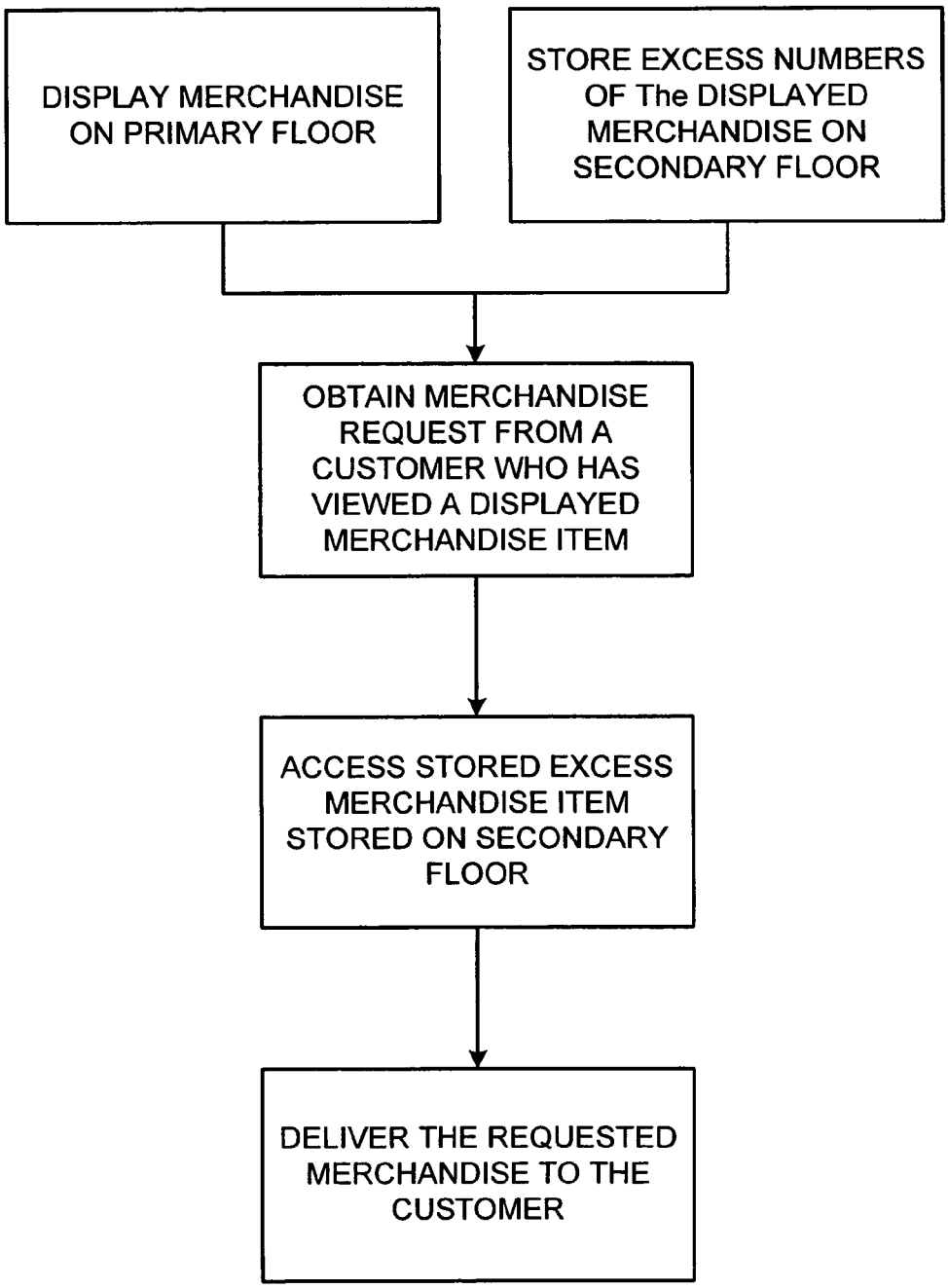
FIG. 10 is a flow diagram for another example method related to the present invention.

According to an alternative method (see FIG. 10), merchandise is displayed on a primary floor and an excess number of the displayed merchandise is stored on a secondary floor. An employee of the store obtains a merchandise request from a customer who had viewed a displayed merchandise item. The employee then accesses stored excess merchandise items on the secondary floor and delivers the requested merchandise to the customer. A further step of the method may include the customer purchasing the delivered merchandise. Further steps of the method may include displaying merchandise on the secondary floor followed by a customer request for the merchandise displayed on the secondary floor, the employee accessing the secondary floor to obtain an excess number of the merchandise displayed on the secondary floor, and delivering the requested merchandise to the customer. According to this method, the merchandise displayed on the secondary floor is viewable from the primary floor by the customer, while the secondary floor is restricted to access by employees of the retail store. Additional methods and method steps fall within the scope of the present invention and may naturally follow as a result of using the building constructions described herein.

The present invention should not be considered limited to the particular examples or materials described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the instant specification.

I claim:

1. A building construction, comprising:

an exterior structure including at least four exterior walls, a primary floor and a roof defining a primary storage space wherein merchandise is stored and displayed;

a secondary floor defining a secondary storage space within the primary storage space, the secondary floor being spaced above the primary floor a distance sufficient for the display of merchandise between the secondary and primary floors, the secondary floor being exposed within the primary interior storage space; and an access structure providing access between the primary floor and the secondary storage space;

wherein an excess number of merchandise items stored on the primary floor are stored in the secondary storage space and accessible via the access structure.

2. The building structure of claim 1, wherein the access structure is a set of stairs.

3. The building structure of claim 1, wherein the access structure is a powered lift mechanism.

4. The building structure of claim 1, wherein the secondary floor is enclosed except for an opening for the access structure.

5. The building structure of claim 1, wherein the secondary floor includes a railing positioned along at least one side of the floor.

6. The building structure of claim 1, wherein the secondary floor is positioned generally at the center of the primary storage space.

7. The building structure of claim 1, wherein the secondary floor is positioned in a corner of the primary storage space.

8. The building structure of claim 1, wherein the secondary floor is positioned along a side and between corners of the exterior structure.

9. The building structure of claim 1, wherein the primary and secondary floors are spaced apart at least 9 feet.

10. The building structure of claim 1, wherein the secondary floor includes a display area wherein at least one merchandise item is capable of being displayed for viewing from the primary floor.

11. The building structure of claim 1, further comprising a ramp that extends from a level substantially coplanar with the primary floor to a level substantially coplanar with the secondary floor.

12. The building structure of claim 11, wherein the ramp is configured for use by a vehicle.

13. A storage arrangement for merchandise in a retail store, the retail store including a primary storage volume defined between a primary floor and a ceiling, and a secondary floor positioned within the primary storage volume, the secondary floor being raised relative to the primary floor a distance sufficient for customers to move between the primary and secondary floors, the arrangement comprising:

a plurality of different merchandise items displayed on the primary floor for selection by a consumer; and an additional number of at least some of the different merchandise items stored on the secondary floor, the additional number of merchandise items being accessible only by an employee of the retail store.

14. The storage arrangement of claim 13, wherein the secondary floor is accessible via an access structure.

15. The storage arrangement of claim 14, wherein the access structure is a set of stairs.

16. The storage arrangement of claim 14, wherein the access structure is a lift mechanism selected from the group consisting of an escalator, a hydraulic lift, an elevator, and an electric lift.

17. The storage arrangement of claim 13, wherein the different merchandise items stored on the secondary floor can be displayed on the secondary floor.

18. The storage arrangement of claim 13, wherein the secondary floor is surrounded by a plurality of secondary wall structures thereby defining a secondary storage volume.

19. The storage arrangement of claim 18, wherein at least one of the secondary wall structures is a rail.

20. The storage arrangement of claim 14, wherein the secondary floor includes an aperture defined therein, and the access structure provides access from the primary floor to the secondary floor through the aperture.

21. A method of obtaining merchandise for a customer in a retail store, the retail store including a ceiling, a primary floor, and a plurality of walls that extend between the ceiling and primary floor, the primary floor defining a primary floor level of the retail store, a display of the merchandise being positioned at the primary floor level in the retail store, and an excess number of the merchandise being stored at a secondary floor level that is positioned vertically above the primary floor level a distance sufficient for the customer to walk between the primary and secondary floor levels, the primary and secondary floor levels being positioned within the same room of the retail store, the method comprising:

obtaining a merchandise request from the customer based on the customer's review of the displayed merchandise;

accessing the stored excess number of the merchandise at the secondary floor level by an employee of the retail store; and delivering the requested merchandise to the customer.

22. The method of claim 21, wherein the merchandise is only displayed on the primary floor level.

23. The method of claim 21, wherein accessing the stored merchandise includes using an access structure to move between the primary and secondary store levels.

24. The method of claim 23, wherein the access structure is a powered lift mechanism.

25. The method of claim 21, further comprising displaying at least one merchandise item on the secondary floor that is not displayed on the primary floor, the displayed merchandise item on the secondary floor being viewable from the primary floor, and storing an excess number of the merchandise from the primary floor at the secondary floor level.

26. A method of retailing merchandise, the method comprising the steps of:

providing a retail space having a primary floor that includes a checkout stand and a plurality of merchandise displays, and a secondary floor positioned vertically above the primary floor a distance sufficient for customers to walk between the primary and secondary floors, the secondary floor being viewable within a portion of the retail space that includes the primary floor;

storing excess numbers of the displayed merchandise on the secondary floor;

obtaining a merchandise request from a customer that views the merchandise displays;

obtaining the requested merchandise from the secondary floor on behalf of the customer; and transacting a purchase of the requested merchandise at the check out stand.

27. The method of claim 26, further comprising displaying merchandise items at a level that is at or above a height of the secondary floor and viewable by a customer positioned at the primary floor, and storing an excess number of the displayed merchandise from the primary floor on the secondary floor.

28. The method of claim 26, wherein access to the secondary floor is limited to employees of the retail store.

29. A merchandise arrangement in a building configured for retail sales, the building defining a first room having a primary floor, and a second room having a secondary floor, the second room being positioned within the first room at a location spaced vertically above the primary floor a distance sufficient for customers to walk between the primary and secondary floors, the arrangement comprising:

a display of merchandise on the primary floor; and storage of a supply of at least some of the displayed merchandise in the second room.

30. The arrangement of claim 29, wherein the second room is defined by the secondary floor and a plurality of walls, a bottom side of the secondary floor and outward facing surfaces of at least some of the plurality of walls being visible from the primary floor.

31. The arrangement of claim 29, further comprising a merchandise display supported by the secondary floor and positioned above the primary floor.

32. The arrangement of claim 29, wherein access to the second room is restricted to retail employees of the building.

33. The arrangement of claim 29, wherein the merchandise displayed on the primary floor is not displayed on the secondary floor.

34. A method of retailing bulk items in a retail store, the method comprising:

displaying at least one bulk item on a primary floor of the retail store;

storing an excess number of the displayed item on a secondary floor of the retail store that is vertically spaced apart from the primary floor at least a distance sufficient for walking between the primary and secondary floors; and obtaining a stored displayed item by an employee of the retail store upon request by a customer of the retail store.

35. The method of claim 34, wherein the secondary floor is spaced vertically above the primary floor.

36. The method of claim 34, wherein the secondary floor is spaced vertically below the primary floor.

37. The method of claim 34, wherein none of the excess number of displayed items that are stored on the secondary floor are displayed on the secondary floor.

* * * * *